US010658094B2

(12) United States Patent
Sun et al.

(10) Patent No.: US 10,658,094 B2
(45) **Date of Patent: *May 19, 2020**

(54) NDFEB MAGNET CONTAINING CERIUM AND MANUFACTURING METHOD THEREOF

(71) Applicant: SHENYANG GENERAL MAGNETIC CO., LTD., Shenyang, Liaoning (CN)

(72) Inventors: Baoyu Sun, Liaoning (CN); Yongli Duan, Liaoning (CN)

(73) Assignee: SHENYANG GENERAL MAGNETIC CO., LTD, Shenyang, Liaoning (CN)

( * ) Notice: Subject to any disclaimer, the term of this patent is extended or adjusted under 35 U.S.C. 154(b) by 628 days.

This patent is subject to a terminal disclaimer.

(21) Appl. No.: 15/389,568

(22) Filed: Dec. 23, 2016

(65) Prior Publication Data

US 2017/0103837 A1 Apr. 13, 2017

(30) Foreign Application Priority Data

Apr. 8, 2016 (CN) ..... 2016 1 0215688

(51) Int. Cl.

| | |
|---|---|
| ***H01F 1/057*** | (2006.01) |
| ***H01F 41/02*** | (2006.01) |
| ***B22F 3/16*** | (2006.01) |
| ***B22F 9/04*** | (2006.01) |
| ***C22C 38/16*** | (2006.01) |
| ***C22C 38/14*** | (2006.01) |
| ***C22C 38/10*** | (2006.01) |
| ***C22C 38/06*** | (2006.01) |
| ***C22C 38/00*** | (2006.01) |
| ***C22C 33/04*** | (2006.01) |
| ***B22F 3/10*** | (2006.01) |
| ***C21D 8/12*** | (2006.01) |
| ***C21D 9/00*** | (2006.01) |

(52) U.S. Cl.

CPC ..... *H01F 1/0577* (2013.01); *B22F 3/1017* (2013.01); *C21D 8/1216* (2013.01); *C21D 8/1244* (2013.01); *C21D 9/0068* (2013.01); *C22C 33/04* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 41/0273* (2013.01); *B22F 2998/10* (2013.01); *B22F 2999/00* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 6,120,620 | A * | 9/2000 | Benz | H01F 1/0577 148/101 |
| 2003/0106615 | A1* | 6/2003 | Hirota | C22B 7/002 148/101 |
| 2007/0157998 | A1* | 7/2007 | Hirota | C22C 1/0441 148/302 |
| 2012/0048431 | A1* | 3/2012 | Nakazawa | C22C 32/0052 148/557 |
| 2017/0098496 | A1* | 4/2017 | Sun | C22C 38/16 |
| 2017/0117073 | A1* | 4/2017 | Sun | H01F 1/0577 |
| 2017/0221615 | A1* | 8/2017 | Chen | H01F 1/0536 |

FOREIGN PATENT DOCUMENTS

| | | | | |
|---|---|---|---|---|
| CN | 105469973 A * | 4/2016 | | H01F 1/0536 |

* cited by examiner

*Primary Examiner* — Xiaowei Su

(57) ABSTRACT

A NdFeB magnet containing cerium and a manufacturing method thereof are provided. The manufacturing method includes steps of: refining a part of raw materials pure iron, ferro-boron, and rare earth fluoride in a crucible, adding a rest of the raw materials into the crucible and refining, casting a refined solution to a surface of a water-cooled rotation roller through a tundish and forming alloy flakes, processing the alloy flakes containing at least two different compositions with hydrogen decrepitation, milling powders, magnetic field pressing, vacuum presintering, machining and sintering, and obtaining the NdFeB magnet containing cerium. The NdFeB magnet containing cerium has a density of 7.5-7.7 g/cm$^3$ and an average particle size of 3-7 μm; comprises a main phase and a grain boundary phase distributed around the main phase. A composite phase containing Tb is provided between the main phase and the grain boundary phase.

11 Claims, No Drawings

NDFEB MAGNET CONTAINING CERIUM AND MANUFACTURING METHOD THEREOF

CROSS REFERENCE OF RELATED APPLICATION

The application claims priority under 35 U.S.C. 119(a-d) to CN 201610215688.4, filed Apr. 8, 2016.

BACKGROUND OF THE PRESENT INVENTION

Field of Invention

The present invention relates to a rare earth permanent magnet field, and more particularly to a NdFeB magnet containing cerium and a manufacturing method thereof Description of Related Arts Due to excellent magnetic performance, the rare earth permanent magnet material gets more and more applications, and is widely applied to nuclear magnetic resonance imaging, computer hard disk drive, sound system, mobile phone and so on. With the energy-saving and low-carbon economy requirements, the NdFeB rare earth permanent magnet material is further applied in fields of automobile part, household appliance, energy-saving and control motor, hybrid electric vehicle, and wind power generation.

In 1983, Japanese Patents No. 1,622,492 and No. 2,137,496 firstly disclosed the NdFeB rare earth permanent magnet material and characteristics, compositions and manufacturing methods thereof. U.S. Pat. Nos. 6,461,565, 6,491,765, 6,537,385, 6,527,874 and 5,645,651 also disclosed manufacturing methods of the NdFeB rare earth permanent magnet material.

Currently, the high-performance rare earth permanent magnet material is generally used to prepare the rare earth permanent alloy through the vacuum melting rapid-solidifying method. In the existing vacuum melting rapid-solidifying process, the rapid-solidifying alloy raw materials including pure iron, ferro-boron, rare earth materials and other additive metals are sent to the crucible to melt for once, so that during the melting process, the rare earth and other more expensive raw materials may be volatilized and lost; in addition, the raw materials are put into the crucible under atmospheric environment, so that the rare earth materials are oxidized, thus increasing the slags during the melting process. The above factors affect the utilization rate of the heavy metal materials, causing the waste to a certain degree. The vacuum melting rapid-solidifying furnace, produced by Japanese ULVAC, adopts the design of secondary feeding, but the object is to fill the loading space from raw material melting in the crucible during the melting, so as to increase the furnace installed capacity, which is not able to resolve the loss of the heavy metal materials at high temperature and serious slags while melting the rare earth materials.

In the manufacturing process of the NdFeB rare earth permanent magnet device, NdFeB raw materials are generally molten to form the alloy, and then the NdFeB alloy is sintered to form the NdFeB block through powder metallurgy method, and then the NdFeB block is machined to form devices with various shapes. Because NdFeB is hard and brittle, in the machining process, a large number of corner wastes are produced. In addition, with the passage of time, some mechanical devices which use NdFeB rare earth permanent magnet are not used again due to failure, life expectancy and other reasons, many scrapped NdFeB permanent magnets are able to be recovered. Due to high material cost of the rare earth permanent magnet materials, methods for recycling rare earth permanent substandard products, waste materials and scrapped NdFeB permanent magnets are always researched and studied in the industry, so as to reduce the raw material cost of the rare earth permanent materials and save the existing natural resources. Due to high oxidation degree of the rare earth permanent waste materials, if these waste materials are molten and used again as the melting raw materials, a large number of slags are produced during the melting process, which results in the limitation of the re-melting process of the waste materials to be unable to be widely applied. Therefore, Japanese related companies commonly adopt the non-remelting process to recycle the rare earth permanent waste materials. For example, ZL 99800997.0 and U.S. Pat. No. 6,149,861 disclosed a method for recycling sintered NdFeB waste materials, in which the waste materials are ground, acid washed and dried, and the product is subjected to calcium reduction treatment, so as to obtain reusable raw material alloy powders, and then other alloy powders are added into the powders for adjusting the composition thereof, to further manufacture the sintered NdFeB permanent magnet material. ZL 02800504.X and U.S. Pat. No. 7,056,393 disclosed a method of using a sintered NdFeB substandard product, in which the sintered NdFeB substandard product is coarsely pulverized by a hydrogen crushing process and then made into fine powders, the fine powders made from the normal raw material are mixed with the fine powers made from the substandard product, and then the sintered NdFeB permanent magnet is manufactured. The above-mentioned method of using non-remelting waste materials is not only complicated in procedure, but also needs to prepare alloy powders with different compositions to adjust components and improve the sintering capacity thereof, which inconveniences the production process. More importantly, in the waste utilization method, due to the non-remelting, the powders made from the waste materials has high contents of oxygen and other impurities, so that the magnetic properties of the manufactured rare earth permanent magnet material are seriously affected.

With the development of NdFeB rare earth permanent magnet, the amount of praseodymium neodymium is increased, the amount of lanthanum cerium is decreased, to ensure the rare earth balance application, it is very important to research NdFeB which is added with lanthanum cerium. Because the added lanthanum cerium obviously decreases the coercive force of the magnet, how to improve the coercive force of the magnet containing lanthanum cerium becomes a very important issue.

SUMMARY OF THE PRESENT INVENTION

The present invention is achieved by following technical solutions.

A NdFeB magnet containing cerium, wherein:

an average grain size of the NdFeB magnet is in a range of 3-7 μm; the NdFeB comprises a main phase and a grain boundary phase distributed around the main phase, the main phase contains rare earth elements and contains at least La, Ce, Pr and Nd, the grain boundary phase contains Ce, N and F; a composite phase containing Tb is provided between the main phase and the grain boundary phase; a total weight percentage of La and Ce in a rare earth R of the NdFeB magnet containing cerium is 1-69%; a total weight percentage of La, Ce, Pr and Nd in the NdFeB magnet containing cerium is 26.5-33.5 wt %; the NdFeB magnet containing cerium contains Mn, N and F with contents of 0.011 wt %≤Mn≤0.049 wt %, 0.021 wt %≤N≤0.09 wt %, and 0.004 wt %≤F≤0.5 wt %, respectively.

Preferably, contents of La+Ce, Tb, N and F in the NdFeB magnet containing cerium are respectively 2 wt %≤La+Ce≤19 wt %, 0.06 wt %≤Tb≤2.9 wt %, 0.03 wt %≤N≤0.09 wt %, and 0.005 wt %≤F≤0.5 wt %.

Preferably, the grain boundary phase contains Ga, Zr and Cu; contents of La+Ce, Pr+Nd, Tb, N and F in the NdFeB magnet containing cerium are respectively 1 wt %≤La+Ce≤19 wt %, 10 wt %≤Pr+Nd≤31 wt %, 0.06 wt %≤Tb≤2.49 wt %, 0.03 wt %≤N≤0.09 wt %, and 0.005 wt %≤F≤0.5 wt %.

Preferably, the grain boundary phase further contains Ti, and a content of Ti in the NdFeB magnet containing cerium is 0.08 wt %≤Ti≤0.35 wt %.

Preferably, the grain boundary phase further contains Nb, and a content of Nb in the NdFeB magnet containing cerium is 0.3 wt %≤Nb≤1.2 wt %.

Preferably, the NdFeB magnet containing cerium further contains Dy, Gd and Ho, and contents thereof in the NdFeB magnet containing cerium are respectively 0.3 wt %≤Dy≤3.9 wt %, 0.3 wt %≤Gd≤5.9 wt %, and 0.6 wt %≤Ho≤4.9 wt %.

Preferably, the NdFeB magnet containing cerium further contains Co, Ga, Zr and Cu, and contents thereof in the NdFeB magnet containing cerium are respectively 0.6 wt %≤Co≤2.8 wt %, 0.09 wt %≤Ga≤0.19 wt %, 0.06 wt %≤Zr≤0.19 wt %, and 0.08 wt %≤Cu≤0.24 wt %.

Preferably, the composite phase further contains Al, both the main phase and the grain boundary phase further contain Al and Tb, contents of Tb and Al in the composite phase are higher than contents of Tb and Al in the main phase and the grain boundary phase; and contents of Tb and Al in the NdFeB magnet containing cerium are respectively 0.1 wt %≤Tb≤1.3 wt % and 0.1 wt %≤Al≤0.6 wt %.

Preferably, the main phase has a structure of $R_2T_{14}B$, the composite phase comprises a phase having a structure of $(R, Tb)_2T_{14}(B, N)$, T represents transition metal elements and contains Fe, Mn and Co, and R represents at least one rare earth element and contains Pr or Nd.

Preferably, the composite phase comprises a phase having a structure of $(R, Tb)T_{12}(B, N)$, T represents transition metal elements and contains Fe, Mn and Co, and R represents at least one rare earth element and contains Pr or Nd.

A method for manufacturing a NdFeB magnet containing cerium, comprising steps of:

(a) sending a portion of raw materials, comprising pure iron, ferro-boron, and rare earth fluoride, into a crucible of a vacuum melting chamber under a vacuum condition, heating the portion of raw materials to a temperature of 1400-1500° C., and then refining the portion of raw materials;

(b) sending a rest of raw materials comprising the rare earth into the crucible of the vacuum melting chamber, injecting argon gas into the crucible, refining the rest of raw materials; casting a molten solution after refining to a surface of a water-cooled rotation roller through a tundish, and forming alloy flakes;

(c) sending at least two kinds of alloy flakes with different compositions into a vacuum hydrogen decrepitation furnace, and processing with a hydrogen decrepitation process; wherein: at least one kind of the alloy flakes is prepared through the steps (a)-(b);

(d) sending the alloy flakes after the hydrogen decrepitation process into a nitrogen jet mill, milling the alloy flakes into powders by the nitrogen jet mill;

(e) under a protection of nitrogen, processing the powders with magnetic field pressing, and obtaining a pressed compact;

(f) under the protection of the nitrogen, sending the pressed compact into a vacuum sintering furnace, vacuum presintering the pressed compact, and obtaining a presintered block;

(g) machining the presintered block into a part; and (h) processing the part with vacuum sintering and aging, and obtaining the NdFeB magnet containing cerium, wherein: a vacuum sintering temperature is controlled in a range of 960-1070° C., an aging temperature is controlled in a range of 460-640° C., a density of the NdFeB magnet containing cerium is 7.5-7.7 g/cm$^3$, an average grain size is in a range of 3-7 μm, the NdFeB magnet containing cerium comprises a main phase and a grain boundary phase distributed around the main phase, the main phase contains rare earth elements and contains at least La, Ce, Pr and Nd, the grain boundary phase contains Ce, N and F, a total weight percentage of La and Ce in a rare earth R of the NdFeB magnet containing cerium is 1-69%, and contents of N and F in the NdFeB magnet containing cerium are respectively 0.021 wt %≤N≤0.09 wt % and 0.004 wt %≤F≤0.5 wt %.

Preferably, the rare earth fluoride comprises at least one member selected from a group consisting of lanthanum fluoride, cerium fluoride, neodymium praseodymium fluoride, terbium fluoride, and dysprosium fluoride.

Preferably, in the step (b), the rest of raw materials further comprises NdFeB scraps; a weight of the NdFeB scraps is 10-60% of a total weight of the raw materials; and a weight of the rare earth fluoride is 0.1-6% of the total weight of the raw materials.

Preferably, in the step (a), a vacuum degree is controlled in a range of $8\times10^{-1}$-$8\times10^{2}$ Pa; and a content of Mn in the NdFeB magnet containing cerium is controlled in a range of 0.011-0.046 wt %.

Preferably, in the step (d), the nitrogen jet mill for milling the alloy flakes into the powders is a nitrogen jet mill without discharging ultrafine powders; the powders prepared through the nitrogen jet mill comprise ultrafine powders having a particle size smaller than 1 μm and conventional powders having a particle size larger than 1 μm, and the ultrafine powders have a higher nitrogen content and a higher heavy rare earth element content than the conventional powders; after uniformly mixing the ultrafine powders and the conventional powders, the ultrafine powders surround the conventional powders, the ultrafine powders surrounding the conventional powders finally form the composite phase of the NdFeB magnet containing cerium, contents of heavy rare earth elements and N in the composite phase are higher than those in the main phase.

Preferably, before "milling the alloy flakes into powders by the nitrogen jet mill" in the step (d), the step (d) further comprises a step of adding a lubricating agent into the alloy flakes after the hydrogen decrepitation process; and the lubricating agent contains F.

Preferably, the hydrogen decrepitation process comprises steps of: firstly adding terbium fluoride powders into the alloy flakes; then heating the alloy flakes to a temperature of 120-800° C., and keeping the temperature for 10 minutes to 8 hours; cooling the alloy flakes to 100-390° C.; absorbing hydrogen; heating the alloy flakes to a temperature of 600-900° C. and keeping the temperature; and cooling the alloy flakes to below 200° C. in sequence; the content of F in the NdFeB magnet containing cerium is in a range of 0.005-0.5 wt %; and a content of Tb in the NdFeB magnet containing cerium is in a range of 0.1-2.9 wt %.

Preferably, in the step (b), after casting the solution to the surface of the water-cooled rotation roller through the tundish and forming alloy flakes, a free surface of the alloy flakes contacts with a surface of another water-cooled rotation roller, alloy flakes with double side cooling are formed, crushed, put into the water-cooled rotation cylinder and secondarily cooled in sequence.

Preferably, in the step (f), the pressed compact is vacuum presintered and the presintered block is obtained, a density of the presintered block is controlled in the range of 5.1-7.4 g/cm$^3$; in the step (g), the presintered block is machined and the part is obtained, powders or a film containing Tb is attached to the surface of the part; in the step (h), the part attached with the powders or the film containing Tb on the surface thereof is sent into the vacuum sintering furnace, and processed with vacuum sintering and aging, the NdFeB magnet containing cerium is obtained, the vacuum sintering temperature is controlled in the range of 1010-1045° C., the aging temperature is controlled in the range of 460-540° C., the density of the NdFeB magnet containing cerium is 7.5-7.7 g/cm$^3$, the average grain size is in the range of 3-6 μm, a content of Tb in the NdFeB magnet containing cerium is in a range of 0.1-2.9 wt %. In this example, powders containing Tb are attached to the surface of the part through a pressure immersing method, or a film containing Tb are attached to the surface of the part through at least one of sputtering, evaporating and spraying method, and then the part attached with the powders or the film containing Tb on the surface thereof is sent to the vacuum sintering furnace, and processed with vacuum sintering and aging.

Preferably, in one example of the present invention, in the step (f), the pressed compact is vacuum presintered and the presintered block is obtained, a density of the presintered block is controlled in the range of 5.1-7.2 g/cm$^3$; in the step (g), the presintered block is machined and the part is obtained, the part is immersed into a solution containing Tb—Al alloy powders after removing oil from the part; in the step (h), the part containing Tb—Al alloy powders is sent into the vacuum sintering furnace, and processed with vacuum sintering and aging, the NdFeB magnet containing cerium is obtained, the vacuum sintering temperature is controlled in the range of 1010-1045° C., the aging temperature is controlled in a range of 460-540° C., the density of the NdFeB magnet containing cerium is 7.5-7.7 g/cm$^3$, a content of Tb in the NdFeB magnet containing cerium is in a range of 0.1-2.9 wt %, the grain boundary phase contains F, the composite phase containing Tb and N is provided between the main phase and the grain boundary phase, the composite phase has the structure of $(R, Tb)_2T_{14}(B, N)$, T represents transition metal elements and contains Fe, Mn and Co, and R represents at least one rare earth element and contains Pr or Nd.

Preferably, in another example of the present invention, in the step (f), the pressed compact is vacuum presintered and the presintered block is obtained; a density of the presintered block is controlled in the range of 5.1-7.2 g/cm$^3$; in the step (g), the presintered block is machined and the part is obtained, the part is immersed into a solution containing terbium fluoride powders after removing oil from the part; in the step (h), the part containing terbium fluoride powders is sent into the vacuum sintering furnace, and processed with vacuum sintering and aging, the NdFeB magnet containing cerium is obtained, the vacuum sintering temperature is controlled in the range of 1010-1045° C., the aging temperature is controlled in the range of 460-540° C., the density of the NdFeB magnet containing cerium is 7.5-7.7 g/cm$^3$, a content of F in the NdFeB magnet containing cerium is in a range of 0.04-0.5 wt %, and a content of Tb in the NdFeB magnet containing cerium is in a range of 0.1-2.9 wt %.

The present invention has following beneficial effects.

1. Through controlling the sintering process, the rare earth nitrides in the grain boundary phase move towards the main phase, so that the rare earth nitride phase connected with the main phase is formed at the edge of the grain boundary phase, a portion of the rare earth nitrides enter the main phase to replace the element B, thus obviously increasing the usage temperature of the magnet.

2. In the prior art, the added La and Ce significantly reduce the coercive force of the magnet. However, in the present invention, the added rare earth fluorides, especially, the respectively or jointly added praseodymium fluoride, neodymium fluoride, dysprosium fluoride and terbium fluoride powders, make up the decrease of the coercive force of the magnet to a large extent after adding La and Ce. The added La and Ce greatly reduce the manufacturing cost of the magnet.

3. Compared with machining after sintering, because the density is low after presintering, a process of machining after presintering has obvious advantages that a machining cost is obviously decreased and a machining efficiency is increased by more than 30%.

These and other objectives, features, and advantages of the present invention will become apparent from the following detailed description, the accompanying drawings, and the appended claims.

DETAILED DESCRIPTION OF THE PREFERRED EMBODIMENT

Obvious effects of the present invention are further illustrated with following examples.

EXAMPLE 1

An alloy raw material, which is made into alloy flakes Al containing Ce, is prepared by raw materials praseodymium neodymium alloy, cerium fluoride, pure iron, ferro-boron, metallic gallium, metallic zirconium, metallic cobalt, metallic aluminum, and metallic copper; the pure iron, ferro-boron, the cerium fluoride and a small amount of the praseodymium neodymium alloy are put into a first charging basket, a rest of the praseodymium neodymium alloy and the metallic gallium are put into a second charging basket, the metallic zirconium, the metallic cobalt, the metallic aluminum, and the metallic copper are put into a third charging basket; and then the first charging basket, the second charging basket and the third charging basket are sent into a vacuum loading chamber of a vacuum melting rapid-solidifying device; after being vacuumized, a vacuum valve between the vacuum loading chamber and a vacuum melting chamber is opened; through a cooperation among a lifting device, a multistage rotation plate, and a trolley which moves back and forth, the raw materials in the first charging basket are sent to a crucible of the vacuum melting chamber under a vacuum condition, heated to 1400-1500° C., and refined; the raw materials in the second charging basket and the third charging basket are also sent to the crucible of the vacuum melting chamber, and then argon gas is injected into the crucible and the raw materials are refined, wherein: during the refining process, a vacuum degree is controlled to be in a range of $8\times10^{-1}$ Pa to $8\times10^{2}$ Pa, vacuum demanganizing is performed; after the refining process, a molten solution is cast to a surface of a water-cooled rotation roller by tilting the crucible through a tundish, alloy flakes are formed; after leaving the water-cooled rotation roller, the alloy flakes fall into an alloy flake crushing device in an alloy flake cooling chamber, the crushed alloy flakes fall into a water-cooled rotation cylinder and secondarily cooled, the alloy flakes Al are prepared; mixed alloy flakes having a composition of $(Pr_{0.25}Nd_{0.75})_{20.1}Ce_{10}Fe_{residual}Co_{0.8}Al_{0.1}B_{0.95}Cu_{0.1}Ga_{0.1}Zr_{0.14}$ are prepared by the alloy flakes Al and other alloy flakes A2 without Ce, sent into a vacuum hydrogen decrepitation furnace and processed by hydrogen decrepitation, wherein: while hydrogen decrepitation, terbium fluoride powders are added to the mixed alloy flakes, and then heated to 650° C., kept at 650° C. for 2 hours, cooled to 260° C., processed by absorbing hydrogen, heated to 650° C. again and kept at the temperature, and finally cooled to below 200° C. in sequence; after the hydrogen decrepitation process, the mixed alloy flakes are sent into a nitrogen jet mill without discharging ultrafine powders, milled into powders by the nitrogen jet mill, and an average particle size of the powders is controlled at about 2.0-2.2 μm; the powders are processed with magnetic field pressing, a pressed compact is obtained, and the pressed compact is presintered into a presintered block with a presintering density of about 5.6 g/cm$^3$; the presintered block is machined into a part; oil is removed from the part, and then the part is immersed into a solution containing the terbium fluoride powders; the part containing the terbium fluoride powders is sent into a vacuum sintering furnace, the part is processed with vacuum sintering and aging, and a vacuum sintering temperature is controlled at about 1040° C., an aging temperature is controlled at about 505° C., and a density of the part is controlled at 7.4 g/cm$^3$; and, after subsequent processes, a NdFeB permanent magnet device D1 is obtained. Through detecting, it is found that the NdFeB permanent magnet device D1 has a magnetic energy product of 50 MGOe and a coercive force of 12 kOe. The NdFeB permanent magnet products, in the same batch of the NdFeB permanent magnet device D1, have few broken edges and corners, and a low rejection rate.

Alternatively, it is feasible to machine the presintered block into the part, and then immerse the part into any other solutions containing powders of Tb, or attach powders containing Tb on a surface of the part through a pressure immersing method, or form a film containing Tb on the surface of the part through at least one method of sputtering, evaporating and spraying; next, the part, attached with the powders or the film containing Tb on the surface thereof, is sent into the vacuum sintering furnace and processed with vacuum sintering, aging, and subsequent processes. The obtained permanent magnet device has a similar magnetic performance as the NdFeB permanent magnet device D1. The permanent magnet products, in the same batch of the permanent magnet device D1, have few broken edges and corners, and a low rejection rate.

EXAMPLE 2

An alloy raw material, which is made into alloy flakes A3 containing Ce, is prepared by raw materials praseodymium neodymium alloy, cerium fluoride, dysprosium iron, pure iron, ferro-boron, metallic gallium, metallic zirconium, metallic cobalt, metallic aluminum, and metallic copper; the pure iron, ferro-boron, the cerium fluoride and a small amount of the praseodymium neodymium alloy are put into a first charging basket, a rest of the praseodymium neodymium alloy, the dysprosium iron and the metallic gallium are put into a second charging basket, the metallic zirconium, the metallic cobalt, the metallic aluminum, and the metallic copper are put into a third charging basket; and then the first charging basket, the second charging basket and the third charging basket are sent into a vacuum loading chamber of a vacuum melting rapid-solidifying device; after being vacuumized, a vacuum valve between the vacuum loading chamber and a vacuum melting chamber is opened; through a cooperation among a lifting device, a multistage rotation plate, and a trolley which moves back and forth, the raw materials in the first charging basket are sent to a crucible of the vacuum melting chamber under a vacuum condition, heated to 1400-1500° C., and refined; the raw materials in the second charging basket and the third charging basket are also sent to the crucible of the vacuum melting chamber, and then argon gas is injected into the crucible and the raw materials are refined, wherein: during the refining process, a vacuum degree is controlled to be in a range of $8\times10^{-1}$ Pa to $8\times10^{2}$ Pa, vacuum demanganizing is performed; after the refining process, a molten solution is cast to a surface of a water-cooled rotation roller by tilting the crucible through a tundish, alloy flakes are formed; after leaving the water-cooled rotation roller, the alloy flakes fall into an alloy flake crushing device in an alloy flake cooling chamber, the crushed alloy flakes fall into a water-cooled rotation cylinder and secondarily cooled, the alloy flakes A3 are prepared; mixed alloy flakes having a composition of $(Pr_{0.25}Nd_{0.75})_{15.1}Ce_{15}Dy_{0.2}Fe_{residual}Co_{0.8}Al_{0.1}B_{0.95}Cu_{0.1}Ga_{0.1}Zr_{0.14}$ are prepared by the alloy flakes A3 and other alloy flakes A4 without Ce, sent into a vacuum hydrogen decrepitation furnace and processed by hydrogen decrepitation, wherein: while hydrogen decrepitation, terbium fluoride powders are added to the mixed alloy flakes, and then heated to 650° C., kept at 650° C. for 2 hours, cooled to 260° C., processed by absorbing hydrogen, heated to 650° C. again and kept at the temperature, and finally cooled to below 200° C. in sequence; after the hydrogen decrepitation process, the mixed alloy flakes are sent into a nitrogen jet mill without discharging ultrafine powders, milled into powders by the nitrogen jet mill, and an average particle size of the powders is controlled at about 2.0-2.2 μm; the powders are processed with magnetic field pressing, a pressed compact is obtained, and the pressed compact is presintered into a presintered block with a presintering density of about 5.5 g/cm$^3$; the presintered block is machined into a part; oil is removed from the part, and then the part is immersed into a solution containing the terbium fluoride powders; the part containing the terbium fluoride powders is sent into a vacuum sintering furnace, the part is processed with vacuum sintering and aging, and a vacuum sintering temperature is controlled at about 1040° C., an aging temperature is controlled at about 505° C., and a density of the part is controlled at 7.3 g/cm$^3$; and, after subsequent processes, a NdFeB permanent magnet device D2 is obtained. Through detecting, it is found that the NdFeB permanent magnet device D2 has a magnetic energy product of 51 MGOe and a coercive force of 13 kOe. The NdFeB permanent magnet products, in the same batch of the NdFeB permanent magnet device D2, have few broken edges and corners, and a low rejection rate.

Alternatively, it is feasible to machine the presintered block into the part, and then immerse the part into any other solutions containing powders of Tb, or attach powders containing Tb on a surface of the part through a pressure immersing method, or form a film containing Tb on the surface of the part through at least one method of sputtering, evaporating and spraying; next, the part, attached with the powders or the film containing Tb on the surface thereof, is sent into the vacuum sintering furnace and processed with vacuum sintering, aging, and subsequent processes. The obtained permanent magnet device has a similar magnetic performance as the NdFeB permanent magnet device D2. The permanent magnet products, in the same batch of the permanent magnet device D2, have few broken edges and corners, and a low rejection rate.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for manufacturing a NdFeB magnet containing cerium, comprising steps of:

(a) sending a portion of raw materials, comprising pure iron, ferro-boron, and rare earth fluoride, into a crucible of a vacuum melting chamber under a vacuum condition, heating the portion of raw materials to a temperature of 1400-1500° C., and then refining the portion of raw materials;

(b) sending a rest of raw materials comprising the rare earth into the crucible of the vacuum melting chamber, injecting argon gas into the vacuum melting chamber, refining the raw materials in the crucible; casting a molten solution after refining to a surface of a water-cooled rotation roller through a tundish, and forming alloy flakes;

(c) sending at least two kinds of alloy flakes with different compositions into a hydrogen decrepitation furnace, and processing with a hydrogen decrepitation process; wherein: at least one kind of alloy flakes is prepared through the steps (a)-(b);

(d) sending the alloy flakes after the hydrogen decrepitation process into a nitrogen jet mill, and then milling the alloy flakes into powders by the nitrogen jet mill;

(e) under a protection of nitrogen, processing the powders with magnetic field pressing, and obtaining a pressed compact;

(f) under the protection of the nitrogen, sending the pressed compact into a vacuum sintering furnace, vacuum presintering the pressed compact, and obtaining a presintered block;

(g) machining the presintered block into a part; and (h) processing the part with vacuum sintering and aging, and obtaining the NdFeB magnet containing cerium, wherein: a vacuum sintering temperature is controlled in a range of 960-1070° C., an aging temperature is controlled in a range of 460-640° C., a density of the NdFeB magnet containing cerium is 7.5-7.7 g/cm$^3$, the average grain size is in the range of 3-7 μm, the NdFeB magnet containing cerium comprises the main phase and the grain boundary phase distributed around the main phase, the main phase contains rare earth elements and contains at least La, Ce, Pr and Nd, the grain boundary phase contains Ce, N and F, the total weight percentage of La and Ce in the rare earth of the NdFeB magnet containing cerium is 1-69%, and the contents of N and F in the NdFeB magnet containing cerium are respectively 0.021 wt %≤N≤0.09 wt % and 0.004 wt %≤F≤0.5 wt %.

2. The method for manufacturing the NdFeB magnet containing cerium, as recited in claim 1, wherein: the rare earth fluoride comprises at least one member selected from the group consisting of lanthanum fluoride, cerium fluoride, neodymium praseodymium fluoride, terbium fluoride, and dysprosium fluoride.

3. The method for manufacturing the NdFeB magnet containing cerium, as recited in claim 1, wherein: in the step (b), the rest of raw materials further comprises NdFeB scraps; a weight of the NdFeB scraps is 10-60% of a total weight of the raw materials; and a weight of the rare earth fluoride is 0.1-6% of the total weight of the raw materials.

4. The method for manufacturing the NdFeB magnet containing cerium, as recited in claim 1, wherein: in the step (a), a vacuum degree is controlled in a range of $8\times10^{-1}$-$8\times10^{2}$ Pa; and a content of Mn in the NdFeB magnet containing cerium is controlled in a range of 0.011-0.046 wt %.

5. The method for manufacturing the NdFeB magnet containing cerium, as recited in claim 1, wherein: the hydrogen decrepitation process comprises steps of: firstly adding terbium fluoride powders into the alloy flakes; then heating the alloy flakes to a temperature of 120-800° C., and keeping the temperature for 10 minutes to 8 hours; cooling the alloy flakes to 100-390° C.; absorbing hydrogen; heating the alloy flakes to a temperature of 600-900° C. and keeping the temperature; and cooling the alloy flakes to below 200° C. in sequence; the content of F in the NdFeB magnet containing cerium is in a range of 0.005-0.5 wt %; and a content of Tb in the NdFeB magnet containing cerium is in a range of 0.1-2.9 wt %.

6. The method for manufacturing the NdFeB magnet containing cerium, as recited in claim 1, wherein: in the step (d), the nitrogen jet mill for milling the alloy flakes into the powders is a nitrogen jet mill without discharging ultrafine powders; the powders prepared through the nitrogen jet mill comprise ultrafine powders having a particle size smaller than 1 μm and powders having a particle size larger than 1 μm, and the ultrafine powders have a higher nitrogen content and a higher heavy rare earth element content than the powders having the particle size larger than 1 μm; after uniformly mixing the ultrafine powders and the powders having the particle size larger than 1 μm, the ultrafine powders surround the powders having the particle size larger than 1 μm.

7. The method for manufacturing the NdFeB magnet containing cerium, as recited in claim 1, wherein: before "milling the alloy flakes into powders by the nitrogen jet mill" in the step (d), the step (d) further comprises adding a lubricating agent into the alloy flakes after the hydrogen decrepitation process; and the lubricating agent contains F.

8. The method for manufacturing the NdFeB magnet containing cerium, as recited in claim 1, wherein: in the step (f), the pressed compact is vacuum presintered and the presintered block is obtained, a density of the presintered block is controlled in a range of 5.1-7.4 g/cm$^3$; in the step (g), the presintered block is machined and the part is obtained, powders or a film containing Tb is attached to a surface of the part; in the step (h), the part attached with the powders or the film containing Tb on the surface thereof is sent into the vacuum sintering furnace, and processed with vacuum sintering and aging, the NdFeB magnet containing cerium is obtained, the vacuum sintering temperature is controlled in the range of 1010-1045° C., the aging temperature is controlled in the range of 460-540° C., the density of the NdFeB magnet containing cerium is 7.5-7.7 g/cm$^3$, the average grain size is in the range of 3-6 μm, a content of Tb in the NdFeB magnet containing cerium is in a range of 0.1-2.9 wt %.

9. The method for manufacturing the NdFeB magnet containing cerium, as recited in claim 8, wherein: after machining the presintered block and obtaining the part, the powders containing Tb are attached to the surface of the part through a pressure immersing method, or the film containing Tb are attached to the surface of the part through at least one of sputtering, evaporating and spraying method, and then the part attached with the powders containing Tb on the surface thereof or the part attached with the film containing Tb on the surface thereof is sent to the vacuum sintering furnace, and processed with vacuum sintering and aging.

10. The method for manufacturing the NdFeB magnet containing cerium, as recited in claim 1, wherein: in the step (f), the pressed compact is vacuum presintered and the presintered block is obtained, a density of the presintered block is controlled in a range of 5.1-7.2 g/cm$^3$; in the step (g), the presintered block is machined and the part is obtained, the part is immersed into a solution containing Tb—Al alloy powders; in the step (h), the part containing Tb—Al alloy powders is sent into the vacuum sintering furnace, and processed with vacuum sintering and aging, the NdFeB magnet containing cerium is obtained, the vacuum sintering temperature is controlled in the range of 1010-1045° C., the aging temperature is controlled in the range of 460-540° C., the density of the NdFeB magnet containing cerium is 7.5-7.7 g/cm$^3$, a content of Tb in the NdFeB magnet containing cerium is in a range of 0.1-2.9 wt %; the grain boundary phase contains F, a composite phase containing Tb and N is provided between the main phase and the grain boundary phase, the composite phase has a structure of $(R, Tb)_2T_{14}(B, N)$, T represents transition metal elements and contains Fe, Mn and Co, and R represents at least one rare earth element and contains Pr or Nd.

11. The method for manufacturing the NdFeB magnet containing cerium, as recited in claim 1, wherein: in the step (f), the pressed compact is vacuum presintered and the presintered block is obtained, a density of the presintered block is controlled in a range of 5.1-7.2 g/cm$^3$; in the step (g), the presintered block is machined and the part is obtained, the part is immersed into a solution containing terbium fluoride powders; in the step (h), the part containing terbium fluoride powders is sent into the vacuum sintering furnace, and processed with vacuum sintering and aging, the NdFeB magnet containing cerium is obtained, the vacuum sintering temperature is controlled in the range of 1010-1045° C., the aging temperature is controlled in the range of 460-540° C., the density of the NdFeB magnet containing cerium is 7.5-7.7 g/cm$^3$, the content of F in the NdFeB magnet containing cerium is in the range of 0.05-0.5 wt %, and a content of Tb in the NdFeB magnet containing cerium is in a range of 0.1-2.9 wt %.

* * * * *